US007448495B2

(12) United States Patent
Sadow

(10) Patent No.: US 7,448,495 B2
(45) Date of Patent: Nov. 11, 2008

(54) IMPACT RESISTANT CUSHION FOR ELECTRONIC EQUIPMENT WITH DIAGONAL CORNER SUPPORT AND CARRYING CASES INCLUDING THE SAME

(75) Inventor: Bernard D. Sadow, Chappaqua, NY (US)

(73) Assignee: BBS Licensing, Inc., Chappaqua, NY (US)

( * ) Notice: Subject to any disclaimer, the term of this patent is extended or adjusted under 35 U.S.C. 154(b) by 0 days.

(21) Appl. No.: 11/361,761

(22) Filed: Feb. 24, 2006

(65) Prior Publication Data

US 2007/0199854 A1 Aug. 30, 2007

(51) Int. Cl.
*B65D 81/03* (2006.01)

(52) U.S. Cl. ..... 206/522; 206/320; 206/591; 383/3

(58) Field of Classification Search ..... 206/320, 206/522, 576, 591–594; 190/18 A; 383/3
See application file for complete search history.

(56) References Cited

U.S. PATENT DOCUMENTS

| | | | | |
|---|---|---|---|---|
| 4,482,054 | A * | 11/1984 | Gardner | 206/594 |
| 4,801,213 | A * | 1/1989 | Frey et al. | 383/3 |
| 5,706,969 | A * | 1/1998 | Yamada et al. | 206/522 |
| 5,755,329 | A * | 5/1998 | Sadow | 206/522 |
| 5,762,198 | A * | 6/1998 | Hung | 206/522 |
| 6,334,534 | B1 * | 1/2002 | Hollingsworth et al. | 206/320 |
| 6,375,009 | B1 * | 4/2002 | Lee | 206/522 |
| 2003/0094394 | A1 * | 5/2003 | Anderson et al. | 206/522 |
| 2005/0109656 | A1 * | 5/2005 | Ishizaki | 206/522 |

* cited by examiner

*Primary Examiner*—Luan K Bui
(74) *Attorney, Agent, or Firm*—Abelman, Frayne & Schwab

(57) ABSTRACT

A cushion for use in the transportation of an article of electronic equipment in a carrying case includes a plurality of bolsters. A bolster is disposed so as to diagonally traverse the corner where the side wall of the carrying case meet to provide a shock absorbing bolster at each corner.

14 Claims, 5 Drawing Sheets

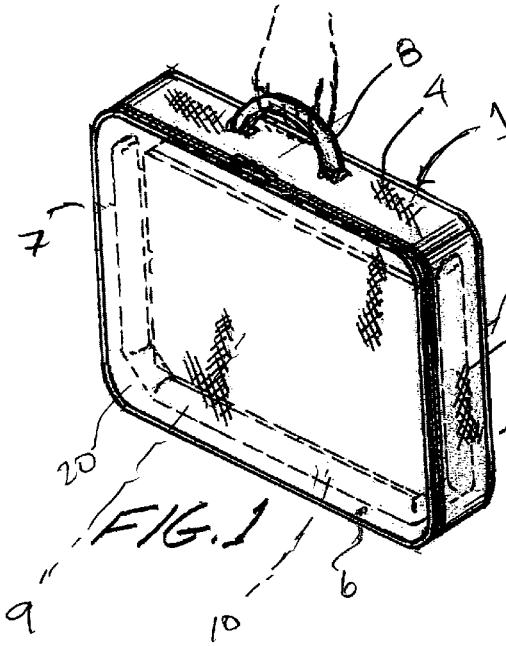
FIG. 1
FIG. 2
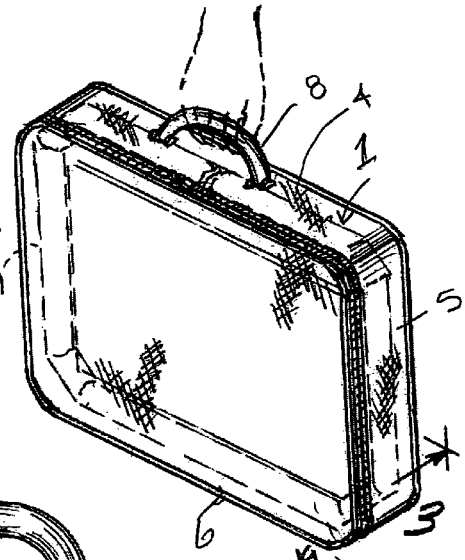
FIG. 3
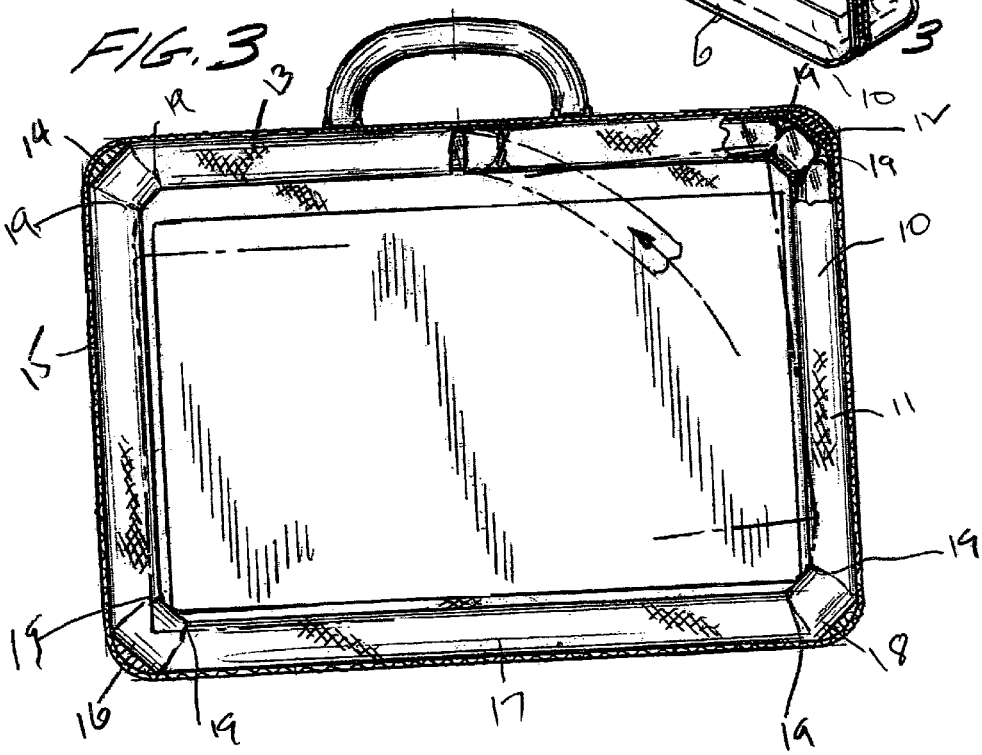

IMPACT RESISTANT CUSHION FOR ELECTRONIC EQUIPMENT WITH DIAGONAL CORNER SUPPORT AND CARRYING CASES INCLUDING THE SAME

FIELD OF THE INVENTION

The present invention relates to impact resistant cushioning for a transportation of an article of electronic equipment, such as a laptop computer, a digital camera, or portable electronic instruments or the like in carrying cases and carrying cases including the same.

BACKGROUND OF THE INVENTION

Many expensive items of electronic equipment are now portable and it is common to transport devices, such as laptop computers, digital cameras, DVD players or the like from place-to-place. Protective carrying cases have been developed, many of which incorporate auxiliary or integral cushioning to reinforce the case and to protect and absorb mechanical shocks or impacts, which could damage the equipment being transported.

Among such devices are those described in U.S. Pat. Nos. 5,622,262, 5,755,329 and 5,819,942, issued to the inventor of the present invention. Those patents describe pressurized air cushions which provide a cushioning effect to electronic equipment stored in a carrying case. In general, the air cushions include an elongated tube-like bladder which is bent at locations to fit within the case and be along the interior side walls of the case. In such configurations the bending of the tubular cushion reduces the cross section at the bend and except for a small air passage that permits air communication throughout the tubular extent, the bends form narrow crimps at the corners or intersections where the tubular bladder changes direction. Those bends have heretofore been generally located at the corners where the side walls intersect.

As a consequence, the corner of the case, (and in turn the corner of the electronic device), is the area which is most vulnerable to impact and shock. However, the corner is often the area of the electronic device, which if impacted having the greatest propensity to result in serious damage to the device.

SUMMARY OF THE INVENTION

The present invention solves this problem by providing cushioning at the corner and positioning the bends in a location where they are significantly less likely to reduce the overall protection of the computer or other article inside the case. The bends are preferably located such that a portion of the cushion diagonally traverses the corner.

By modifying the location of the bends such that the bladder diagonally traverses the corner, in addition to having a cushioning medium at the corner, a triangular air pocket is created between the bladder and the corner of the carrying case.

The cushioning support can be included as an auxiliary member for a carrying case—or as an integral member which provides a cushioning effect on at least one and preferably all corners of the case.

In a preferred embodiment the corner is provided with an auxiliary shaping support member, both to retain the corner shaping and provide an additional ambient air pocket to assist against impact and shock.

The present invention provides either as an auxiliary device or as integral to a carrying case, a cushioning arrangement for use in a carrying case for electronic equipment, which cushioning arrangement preferably is filled with a gas or liquid and maintains inflation—or includes or is formed of other shock absorbing materials and which in at least two corners of the case positions the cushioning spaced apart from and diagonally across each corner. Although the invention has been described using pressurized air as the cushioning medium, it is contemplated that other cushioning medium such as liquids or jells can be used without departing from the spirit of the invention.

In a like manner, the bladder itself may be formed of a resilient cushion-like material. A typical carrying case is generally rectilinear and either accessible from a top covered opening such as in the form of a briefcase or portfolio, or accessible by a pivotal front wall with a hinged cover, such as found in a typical attache case.

In accordance with the present invention, a cushion, preferably tubular, extending substantially parallel to selected interior surface of the carrying case, which for purposes of this illustration is an air filled cushion.

Preferably, the cushion is constructed of a unitary or reinforced bladder having a plurality of narrowed, often partially transversely sealed areas which form sealed hinged-like portions and which permit the cushion to be bent and seat along the side perimeter walls of the carrying case (or a lesser area defined by dividers which permit compartmentalization of the interior of the case). The bladder is adapted to extend along at least one of the inner side walls of the surface of the carrying case sought to be cushioned, with bladder extending at a diagonal so as to span a corner between the side walls or wall dividers and define a somewhat triangular cross-sectional space between the bladder and the corner of the case at the adjoining corner.

As noted, the cushion has, at least in its preferred embodiments, an internal cavity adapted to be filled with a cushioning medium. If the medium is air, it is preferable that it be air in an elevated pressurized condition above the external ambient pressure such as described in U.S. Pat. No. 5,622,262, whose teachings are incorporated by reference herein. As well, the sealing of the sections of the cushion to create an arrangement of continuous bolsters with hinged transitions between each bolster can be accomplished as disclosed in U.S. Pat. No. 5,622,262, although in accordance with the present invention, the additional reinforcement layer disclosed in the patent is optional.

BRIEF DESCRIPTION OF THE DRAWINGS

The teachings of the present invention can be more readily understood by considering the following detailed description in conjunction with the accompanying drawings in which:

FIG. 1 is a perspective view of a carrying case illustrating in dotted lines an embodiment of a cushion of the present invention and having a laptop computer positioned therein;

FIG. 2 is a perspective view of the carrying case of FIG. 1 with a second embodiment of the cushion of the invention with the laptop computer;

FIG. 3 is a cross-sectional view taken along line 3-3 of FIG. 2;

DETAILED DESCRIPTION OF THE INVENTION

Figure 4:
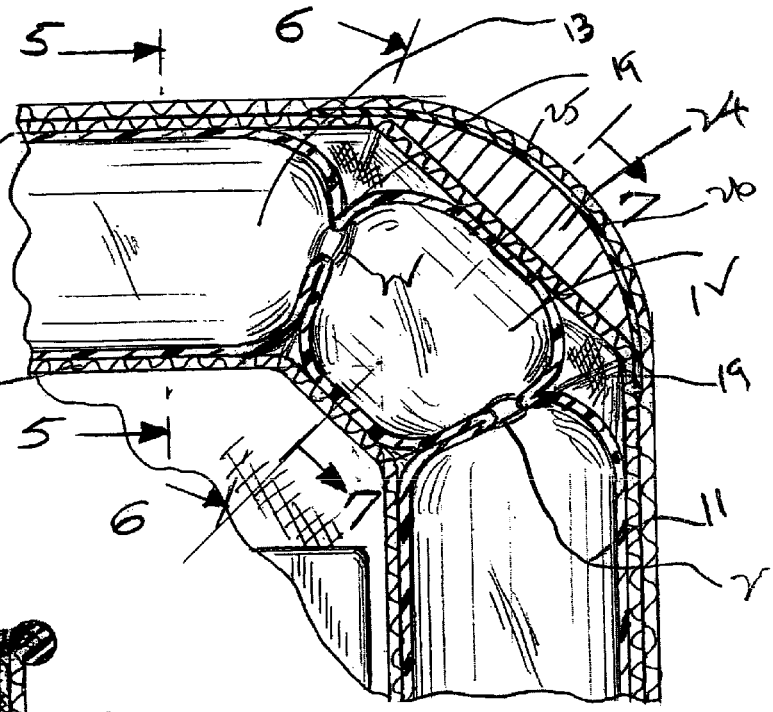
FIG. 4 is a detailed sectional view of a carrying case and a cushion of the present invention.

To facilitate an understanding of the invention, the same reference numerals have been used, when appropriate, to designate the same or similar elements that are common to the figures. Unless stated otherwise, the features shown and described in the figures are not drawn to scale, but are shown for illustrative purposes only.

Although the present invention will be described with reference to an air cushion installed in a carrying case, it should be understood that the apparatus of the present invention may be used on any item of luggage such as a portfolio, a briefcase, or a suitcase and the cushioning can be provided by the nature of the constituents of the cushion or a medium other than air.

As well, although a laptop computer is described as the article being protected, it will be appreciated by one skilled in the art that it is only exemplary and, as well, the carrying case can be shaped differently to accommodate the article to be protected.

Moreover, the cushion member can be installed in any preexisting carrying case or can be integrated into the design of a carrying case.

Referring to FIGS. 1 through 3, the carrying case 1 is in the nature of an attache case having a front top wall 2 which serves as a lid to provide access to the carrying case, a rear wall 3 and peripheral side walls 4, 5, 6 and 7 respectively with a carrying handle 8 on top of and engaged wit the peripheral side wall 4.

It is to be appreciated that there are other types of carrying cases such as those which are opened at the top often with a flap, which are often referred to as portfolios or briefcases. In carrying cases of the portfolio type, since access is from the top, the protective cushion does not generally traverse the top and only extends along the remaining three side walls of the case, for example as shown in FIG. 1. The cushion 10 illustrated in the embodiment of FIG. 2, being in an attache type case, extends along the inner surfaces of all four side walls 4, 5, 6 and 7. It is understood that often carrying cases are provided with adjustable dividers so as to provide an interior wall arrangement adapted to the dimensions of a smaller laptop computer. As used herein, the term peripheral side walls is intended to also include walls formed by adjustable dividers.

The air cushion illustrated in FIGS. 1 through 9 preferably comprises a unitary bladder segmented into a number of bolsters 11 through 18 respectively, each of which is separated by a hinged portion 19. As noted, although the air cushion 10 is shown as a single extent bent and connected at distal ends, it would be appreciated to one skilled in the art that the bladders can be formed by interconnecting a series of discrete bladders.

Figure 9:
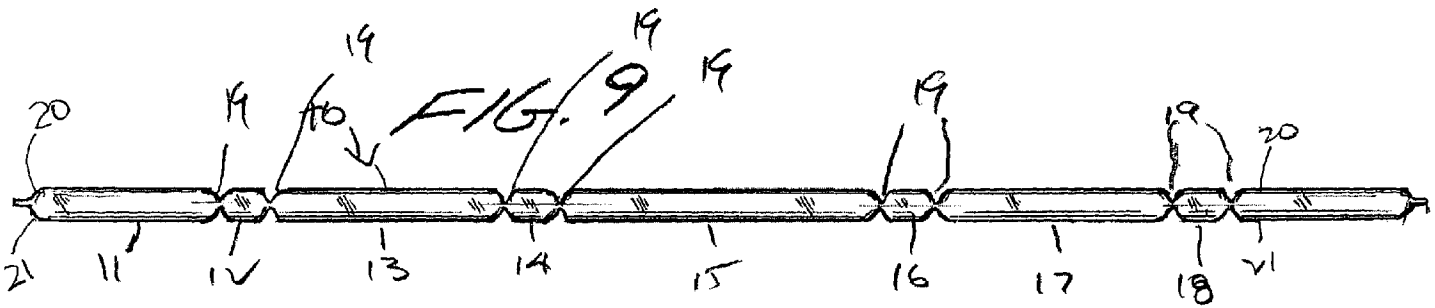
FIG. 9 is a side view of the cushion of FIG. 8 shown prior to the joining of the two distal end portions.
Figure 11:
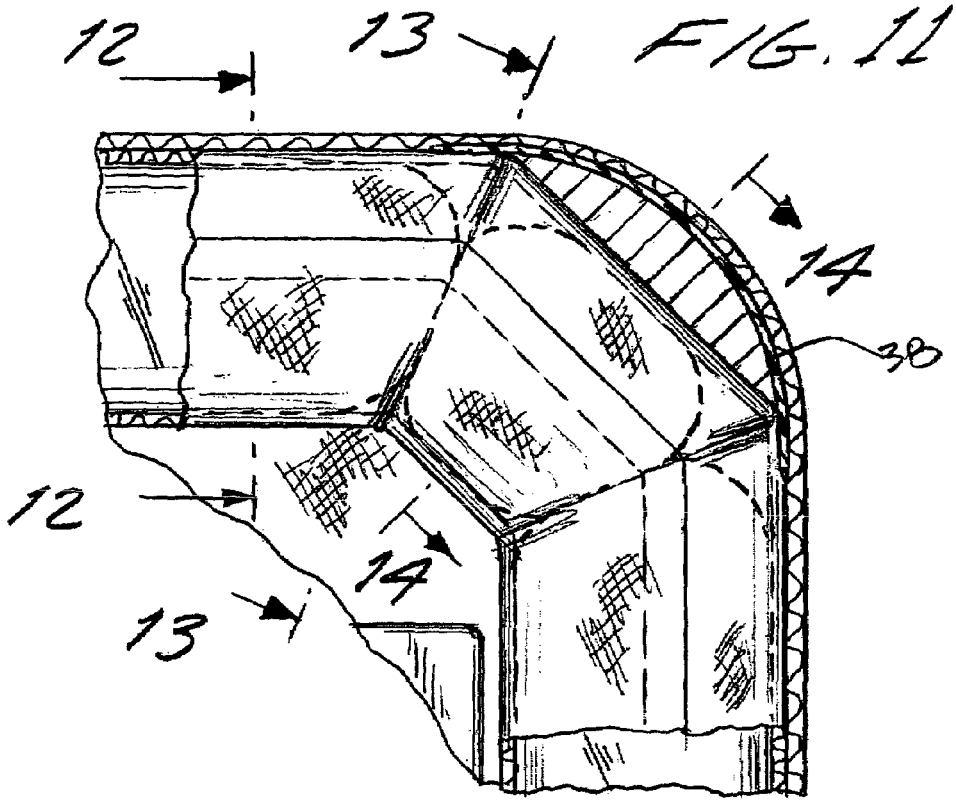
FIG. 11 is a detailed cross-sectional view of a carrying case with the cushion of FIG. 10.

Although the invention is not limited to a particular manufacturing protocol, as best illustrated in FIG. 9, the cushion may be constructed of two plastic strips or webs 20 and 21 which are attached along longitudinal edges (not shown). In the embodiment illustrated, the materials used are air impervious and when the strips 20, 21 are interconnected along their longitudinal edges they form a sealed chamber able to sustain pressurized air or other cushioning medium.

As will also be understood by one of ordinary skill in the art, the tubular members can be formed by other means, for example, by folding a single sheet and bond the free edges. The cushion 10 is divided into discrete bolsters 11 through 18 (or indeed into an endless series of bolsters) with the various bolsters separated by hinged portions 19 at pre-selected intervals.

The hinges 19 permit the cushion 10 to bend flexibly, thus defining the respective bolsters.

The flexible plastic material can be selected from any number of appropriated materials such as polyvinyl chloride, thermoplastic urethane (TPU) and the like and can be formed by a continuous extrusion process to form a tubular configuration.

As well, if it is desired the cushion 10 can be reinforced with a layer of material that has a lesser ability to expand thus shaping and reinforcing the air cushion as described in U.S. Pat. No. 5,662,262.

Figure 5:
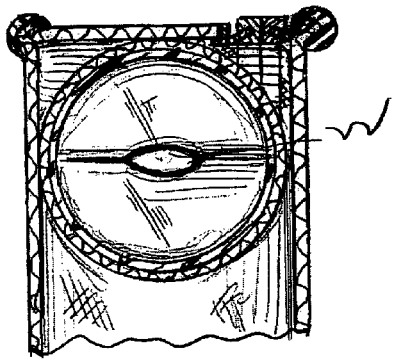
FIG. 5 is a cross-sectional view taken along lines 5-5 of FIG. 4.
Figure 7:
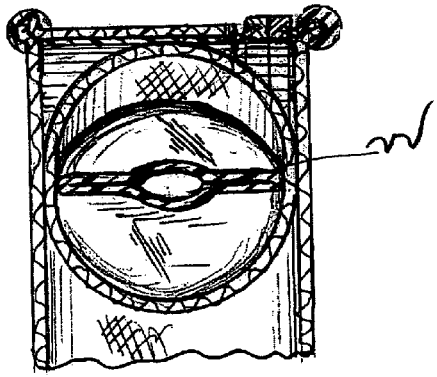
FIG. 7 is a cross-sectional view taken along lines 7-7 of FIG. 4.
Figure 6:
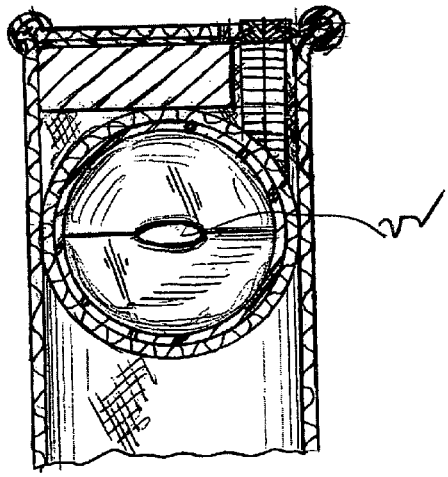
FIG. 6 is a cross-sectional view taken along lines 6-6 of FIG. 4.

To permit continuous communication between the bolsters the sealing mechanism which creates the hinged portion 19 leaves open a somewhat centralized section 22 as best shown in FIGS. 5 and 6. All of the bolsters are thus preferably in fluid communication with each other except for the sealed distal end portions of the air cushion 10, which distal ends are in a four-sided arrangement being placed into juxtaposition to complete the peripheral protection.

As illustrated in FIG. 1 the bolsters are capable of flexing and as mounted within a carrying case 1 can accommodate a wide variety of laptop computers of varying dimensions. As noted, the carrying case may also include dividers (not shown) which permit modification of the dimensions of the interior of the case. Cushions may be provided of an appropriate dimension to be retained either along the interior peripheral side walls of the carrying case or the interior walls defined by the carrying case dividers creating an interior compartment of lesser dimension.

The air cushion may be mounted within the carrying case 1 in any number of ways including a simple emplacement within the case; maintenance in a position with the assistance of securement means such as hook and loop fasteners (not shown) or by providing within the case a sleeve 23 such as shown in section and FIG. 4. As illustrated in FIG. 1 through 4, the bolsters 11 through 18 and the hinged portions 19 are so located such that there is a bolster at the corner which extends in a diagonal direction with respect to the corner.

As will also be apparent from this disclosure, the individual sections of the bolster, e.g., as illustrated in FIG. 9, can be completely isolated from each other by heat sealing. In another embodiment, (not shown) the individual sections can be completed separated one from another, or be produced in shorter adjoining sections, which when combined will provide the desired degree of protection along one or more of the side walls of the case. In the embodiment in which the bolster sections are separated, it will be necessary to contain them in a sleeve in order to maintain their proper spatial relationship and orientation. The sleeve can then be secured to the interior of the case, as by adhesive bonding, the use of hook and loop fasteners that will permit their removal and/or replacement, or by other means well known in the part. From the above additional embodiments, it will be understood that the invention broadly comprehends the use of fluid filled cushioning bolsters that are positioned to extend diagonally across at least the corners of the case which are most likely to receive an impact during transportation of a laptop computer or in the event that the case is inadvertently dropped. As previously described, these diagonal corner bolsters define a generally triangular area at the corner of the case where severe impacts are most likely to occur and result in significant shock forces being transmitted to the computer or other electronic device. The diagonal cushioning and adjoining free space serves to isolate the contained article from the shock forces.

Thus, unlike prior art devices in which the hinge is at the corner and the corner is thus without any significant degree of cushioning, in accordance with the present invention the corner provides a cushioned protective bolster for the corner of the electronic device. As illustrated in FIG. 4, the diagonal positioning of the air cushion result in it being somewhat spaced away from the corner of the carrying case. The space (shown as 24 in FIG. 4) creates or defines a generally triangular open region and an additional air pocket between the bolster and the corner of the case. Although ambient, the air pocket provides additional cushioning to the corner. In the event of a severe impact, such as where the case falls some distance and lands on a corner, the diagonal section of the bolster can also flex into the open corner space to reduce the effective impact force experienced by the computer.

If the carrying case is constructed of relatively soft and somewhat malleable material, the corner 25 might have a tendency to collapse and/or not maintain its configuration. In such instances, the corner 25 can be reinforced with a stiffening reinforcement member 26.

Figure 8:
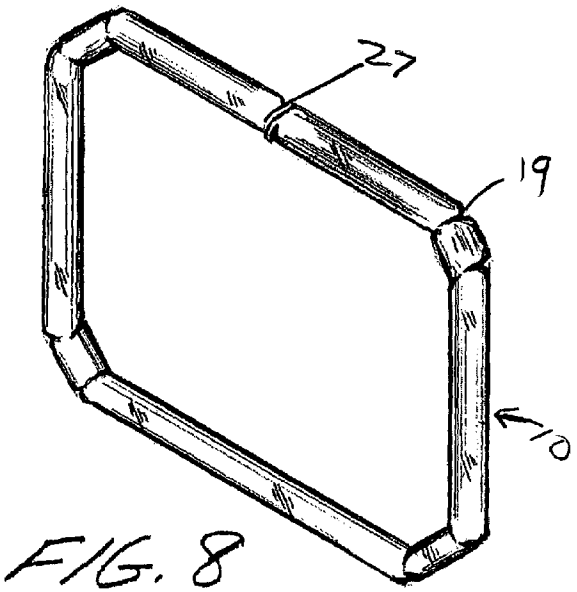
FIG. 8 is a perspective view of an air cushion in accordance with the present invention.

As illustrated in FIG. 8, in an attache type case, the bolsters extend along the interior peripheral side walls of all four walls and the distal ends of the bolsters are connected at a convenient location such as midway across a peripheral side wall, shown at 27.

Figure 10:
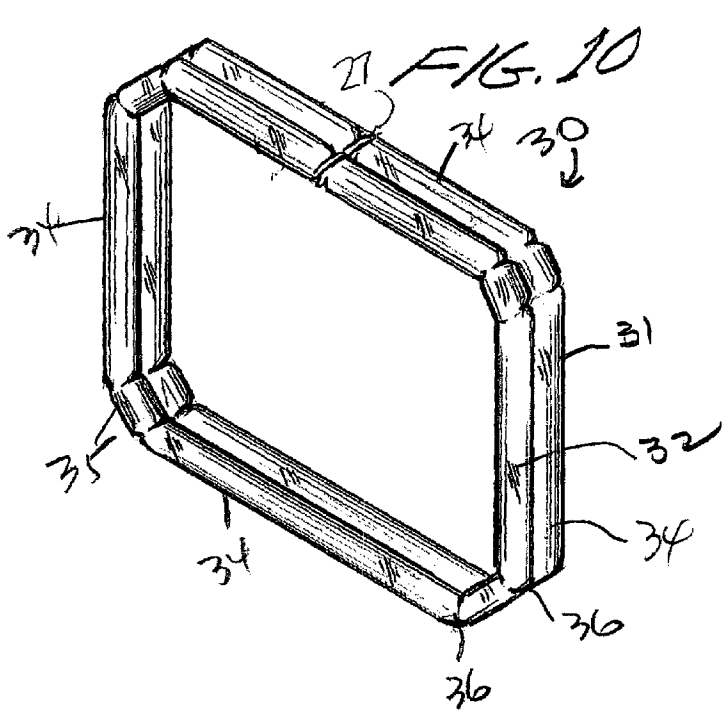
FIG. 10 is a perspective view of an alternative cushion in accordance with the present invention.
Figure 12:
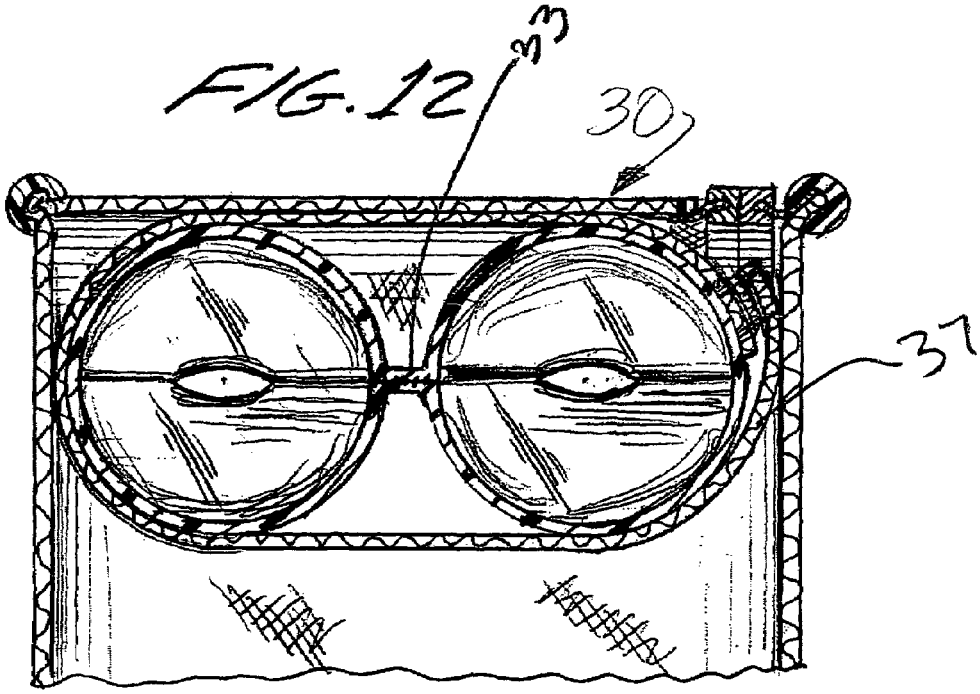
FIG. 12 is a cross-sectional view taken along lines 12-12 of FIG. 11.
Figure 13:
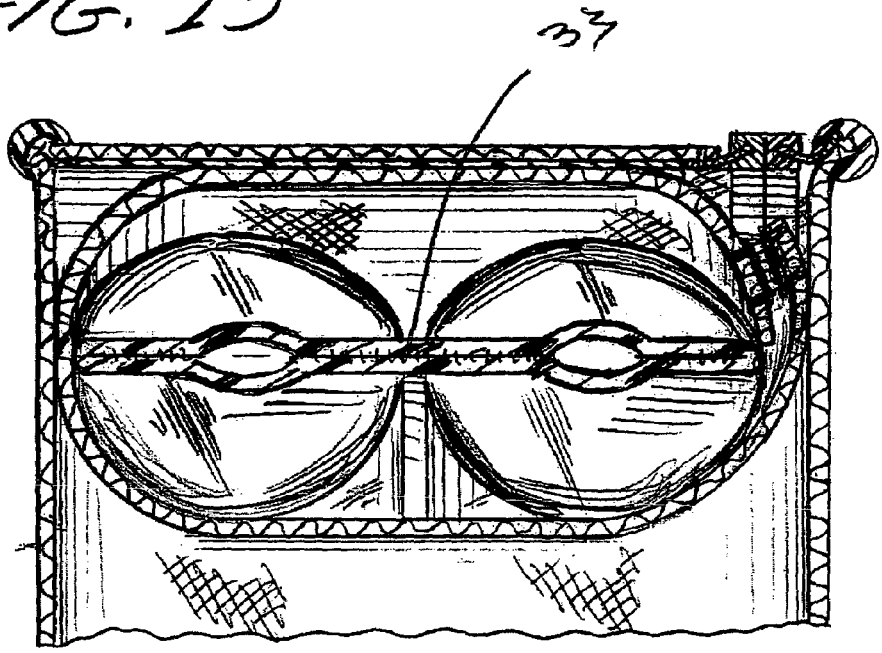
FIG. 13 is a cross-sectional view taken along line 13-13 of FIG. 11.
Figure 14:
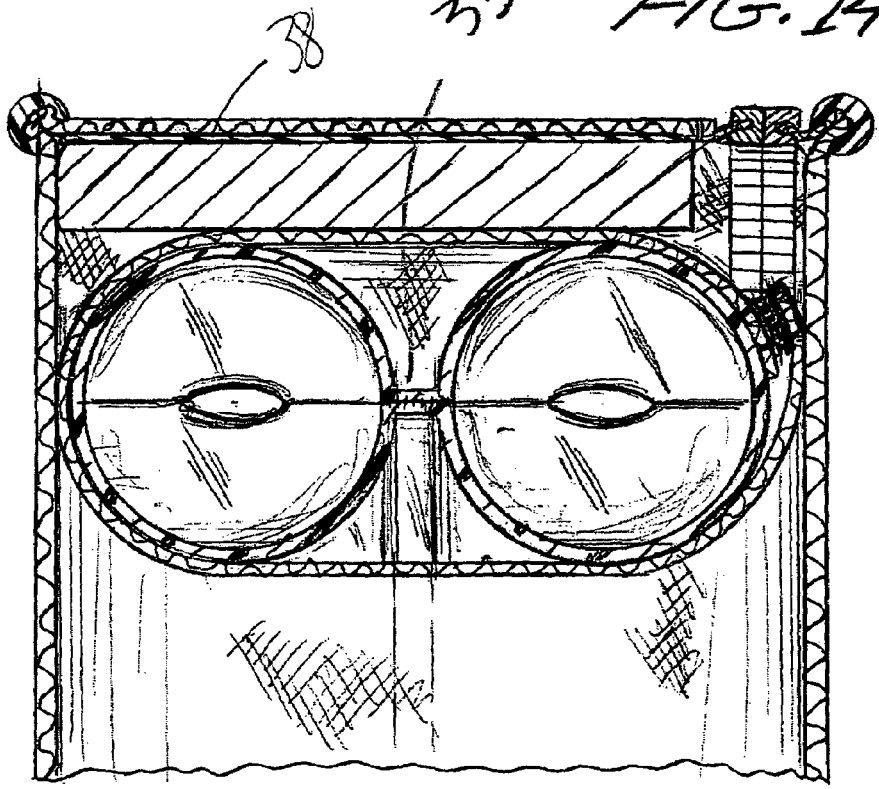
FIG. 14 is a cross sectional view taken along lines 14-14 of FIG. 11.

Referring to FIG. 10, a dual cushion configuration 30 formed of two cushions 30, 31 longitudinally joined together is illustrated. The dual air cushion configuration can be formed in a single operation from two layers which are separated by a longitudinal seal 33 (see FIG. 12 through 14), but are otherwise generally formed in the manner described with regard to cushion 10. The dual cushion configuration also includes a series of side wall bolsters 34 and corner bolsters 35 and hinges 36. If desired, an additional outer cover 37 can be provided.

As best illustrated in FIGS. 11 through 14, the dual cushion 30 provides corner reinforcement in the same manner generally described with regard to cushion 10 and, as well, the carrying case, depending upon the rigidity of its construction, may include a stiffening reinforcement 38.

Although various embodiments that incorporate the teachings of the present invention have been shown and described, those skilled in the art can readily devise many other varied embodiments that still incorporate these teachings.

What is claimed is:

1. An impact-absorbing cushioned carrying case for use in protectively transporting a laptop computer, the case having opposing front and rear walls joined by at least three peripheral sidewalls and being fitted with a pressurized, permanently inflated, generally tubular bolster fabricated from an air-impervious inextensible polymeric material and divided into a plurality of contiguous bolster sections by transverse regions of reduced cross-section that form hinge portions, the improvement comprising:

at least two diagonal bolster sections, each of which extends diagonally to span a corner formed by adjacent sidewalls and is spaced away from and does not contact the interior corner of the case, thereby forming a generally triangular open space with the corner portion of the case, each of the diagonal bolster sections being flanked by an adjoining sidewall bolster section that is positioned adjacent to, and extends continuously along a sidewall of the case, the sidewall bolster sections being in close-fitting relation to the interior surface of, and substantially coextensive with the sidewalls of the case.

2. The case of claim 1 which includes two diagonal bolster sections each spanning one of two adjacent corners and three sidewall sections, one of which extends the length of the sidewall between the diagonal bolster sections.

3. The case of claim 1 which includes four diagonal bolster sections and at least three sidewall bolster sections that extend continuously along the sidewalls between the diagonal bolster sections.

4. The case of claim 3 which opens along a fourth peripheral sidewall to provide access to the computer, further comprising at least one moveable sidewall bolster section spanning the fourth sidewall opening, the bolster section being releasably secured to provide access to the computer carried in the case.

5. The carrying case of claim 4 in which one end of the moveable sidewall bolster is joined to a diagonal bolster section along a hinge portion and the opposite end of which is releasably secured to a diagonal bolster in an adjacent corner, either directly, or indirectly through an intermediate sidewall bolster section.

6. The carrying case of claim 4 in which the bolster section is releasably secured by hook-and-loop fasteners.

7. The carrying case of claim 1 which is constructed with rigid sidewalls, front and rear walls and wherein the bolster comprises four diagonal bolster sections and four sidewall bolster sections, the sidewall bolster sections being removably secured to interior surfaces of the case.

8. The carrying case of claim 1 in which the bolster is contained in a cover.

9. The carrying case of claim 1 in which the bolster is removably secured in the case by hook-and-loop fasteners.

10. The carrying case of claim 1 which includes at least two parallel aligned bolsters.

11. The carrying case of claim 1 in which the longitudinal cross-section of the diagonal bolster section is trapezoidal.

12. The carrying case of claim 4 in which the fourth sidewall is closed by a zipper.

13. An impact-absorbing cushioned carrying case for use in protectively transporting a laptop computer, the case having opposing front and rear walls joined by at least three peripheral sidewalls and being fitted with a pressurized, permanently inflated, generally tubular bolster fabricated from an air-impervious inextensible polymeric material and divided into a plurality of contiguous bolster sections by transverse regions of reduced cross-section that form hinge portions, the improvement comprising:

at least two diagonal bolster sections, each of which extends diagonally to span a corner formed by adjacent sidewalls and is spaced away from and does not contact the interior corner of the case, each of the diagonal bolster sections being flanked by an adjoining sidewall bolster section that is positioned adjacent to, and extends continuously along a sidewall of the case, the sidewall bolster sections being in close-fitting relation to the interior surface of, and substantially coextensive with the sidewalls of the case, the hinged portions at the opposing ends of each of the diagonal bolster sections including a passageway for fluid communication between the bolsters.

14. An impact-absorbing cushioned carrying case for use in protectively transporting a laptop computer, the case having opposing front and rear walls joined by at least three peripheral sidewalls and being fitted with a pressurized, permanently inflated, generally tubular bolster fabricated from an air-impervious inextensible polymeric material and divided into a plurality of contiguous bolster sections by transverse regions of reduced cross-section that form hinge portions, the improvement comprising:

at least two diagonal bolster sections, each of which extends diagonally to span a corner formed by adjacent sidewalls and is spaced away from and does not contact the interior corner of the case, thereby forming a generally triangular open space with the corner portion of the case, an impact absorbing member positioned between each of the at least two diagonal sections and the respective adjacent corner of the case, each of the diagonal bolster sections being flanked by an adjoining sidewall bolster section that is positioned adjacent to, and extends continuously along a sidewall of the case, the sidewall bolster sections being in close- fitting relation to the interior surface of, and substantially coextensive with the sidewalls of the case.

* * * * *